US008276228B1

(12) United States Patent
Gant et al.

(10) Patent No.: US 8,276,228 B1
(45) Date of Patent: Oct. 2, 2012

(54) PORTABLE CHANGING TABLE

(76) Inventors: Alexis Gant, Winchester, CA (US); Justin Gant, Winchester, CA (US)

( * ) Notice: Subject to any disclaimer, the term of this patent is extended or adjusted under 35 U.S.C. 154(b) by 0 days.

(21) Appl. No.: 13/187,400

(22) Filed: Jul. 20, 2011

Related U.S. Application Data

(63) Continuation of application No. 12/884,090, filed on Sep. 16, 2010, now Pat. No. 8,001,637.

(60) Provisional application No. 61/242,899, filed on Sep. 16, 2009.

(51) Int. Cl.
*A47C 9/00* (2006.01)

(52) U.S. Cl. ..... 5/655; 5/947

(58) Field of Classification Search ..... 5/655, 947; 108/42, 48
See application file for complete search history.

(56) References Cited

U.S. PATENT DOCUMENTS

| | | | | |
|---|---|---|---|---|
| 3,644,947 | A * | 2/1972 | Padera | 5/100 |
| 4,862,611 | A * | 9/1989 | Wright | 38/103 |
| 5,170,719 | A * | 12/1992 | Pestone | 108/48 |
| 5,483,761 | A * | 1/1996 | Simpson | 38/137 |
| 2010/0138995 | A1 * | 6/2010 | Smith | 5/424 |

* cited by examiner

*Primary Examiner* — Fredrick Conley
(74) *Attorney, Agent, or Firm* — Christensen O'Connor Johnson Kindness PLLC

(57) ABSTRACT

A portable changing table of the present disclosure includes at least one extendable arm assembly moveable between a retracted position and an extended position. The at least one extendable arm assembly is removably securable to a support structure. The portable changing table further includes a collapsible frame hingedly secured to the at least one extendable arm assembly, wherein the collapsible frame is moveable between a stowed position and a deployed position. The portable changing table further includes a flexible support member secured to a portion of the collapsible frame. The flexible support member extends across a portion of the collapsible frame in the deployed position.

18 Claims, 12 Drawing Sheets

PORTABLE CHANGING TABLE

CROSS-REFERENCES TO RELATED APPLICATIONS

This application is a continuation of U.S. patent application Ser. No. 12/884,090, filed Sep. 16, 2010, and claims the benefit of U.S. Provisional Patent Application No. 61/242,899, filed Sep. 16, 2009, the disclosures of which are hereby expressly incorporated herein by reference.

BACKGROUND

Parents and caregivers of infants and young children that wear diapers are frequently obliged to perform diaper changes away from home. The most convenient place to perform a diaper change is usually in a public restroom. However, many public restrooms, particularly men's restrooms, do not provide a diaper changing station. In restrooms where there is a diaper changing station, the diaper changing station is often soiled or even broken. Parents and caregivers are faced with the choice of using a dirty and potentially unsafe diaper changing station, the restroom counter, or the restroom floor to change the infant's or child's diaper. Thus, there exists a need for a changing table that is sufficiently portable and compact so as to provide a safe and sanitary surface for performing diaper changes on the go.

SUMMARY

A portable changing table of the present disclosure includes at least one extendable arm assembly moveable between a retracted position and an extended position. The at least one extendable arm assembly is removably securable to a support structure. The portable changing table further includes a collapsible frame hingedly secured to the at least one extendable arm assembly, wherein the collapsible frame is moveable between a stowed position and a deployed position. The portable changing table further includes a flexible support member secured to a portion of the collapsible frame. The flexible support member extends across a portion of the collapsible frame in the deployed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
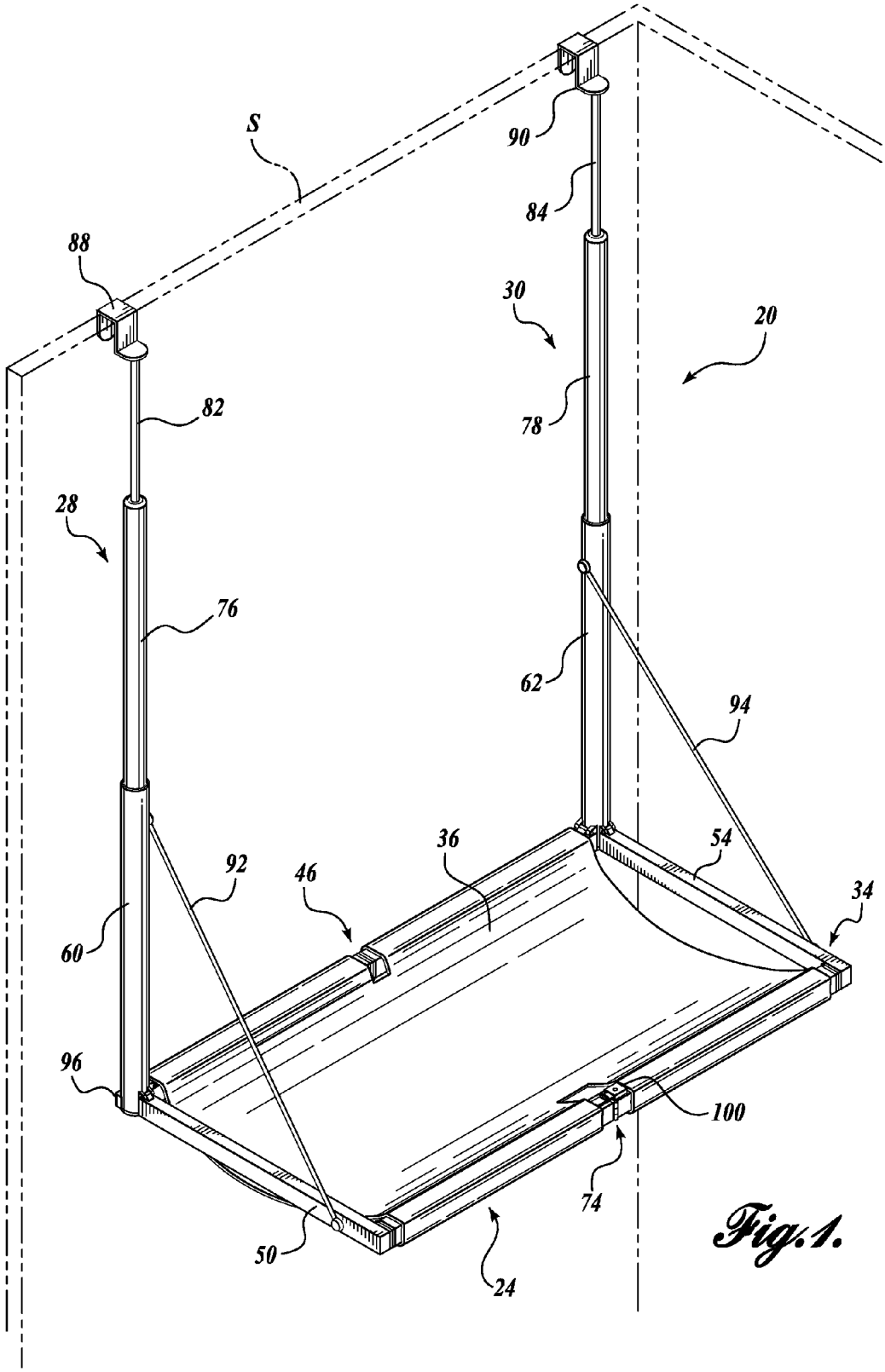
FIG. 1 is an isometric view of a portable changing table formed in accordance with one embodiment of the present disclosure, wherein the portable changing table is shown in a deployed position.

A portable changing table 20 formed in accordance with one embodiment of the present disclosure may best be understood by referring to FIG. 1. Generally described, the portable changing table 20 includes a collapsible base 24 hingedly coupled to first and second extendable arm assemblies 28 and 30. The first and second extendable arm assemblies 28 and 30 are removably securable to, for instance, an upper portion of a bathroom stall S. Once secured to the bathroom stall S, the arm assemblies 28 and 30 extend and the base 24 may be deployed so that a baby may be placed on the base 24 to change the baby's diaper. After use, the extendable arm assemblies 28 and 30 are retracted and the base 24 is collapsed to conveniently stow and transport the portable changing table 20 within, for instance, a diaper bag.

Although the portable changing table 20 will be hereinafter described as being suitable for changing a baby's diaper within a bathroom stall, it should be appreciated that the portable changing table 20 may instead be used in any other suitable manner or in any desired environment or situation. Moreover, although the portable changing table 20 is described as being compact and portable when in the collapsed position, such as to fit within a diaper bag or purse, the portable changing table 20 may be any desired size. Thus, the following description and illustrations herein should not be seen as limiting the scope of the present disclosure.

Figure 2:
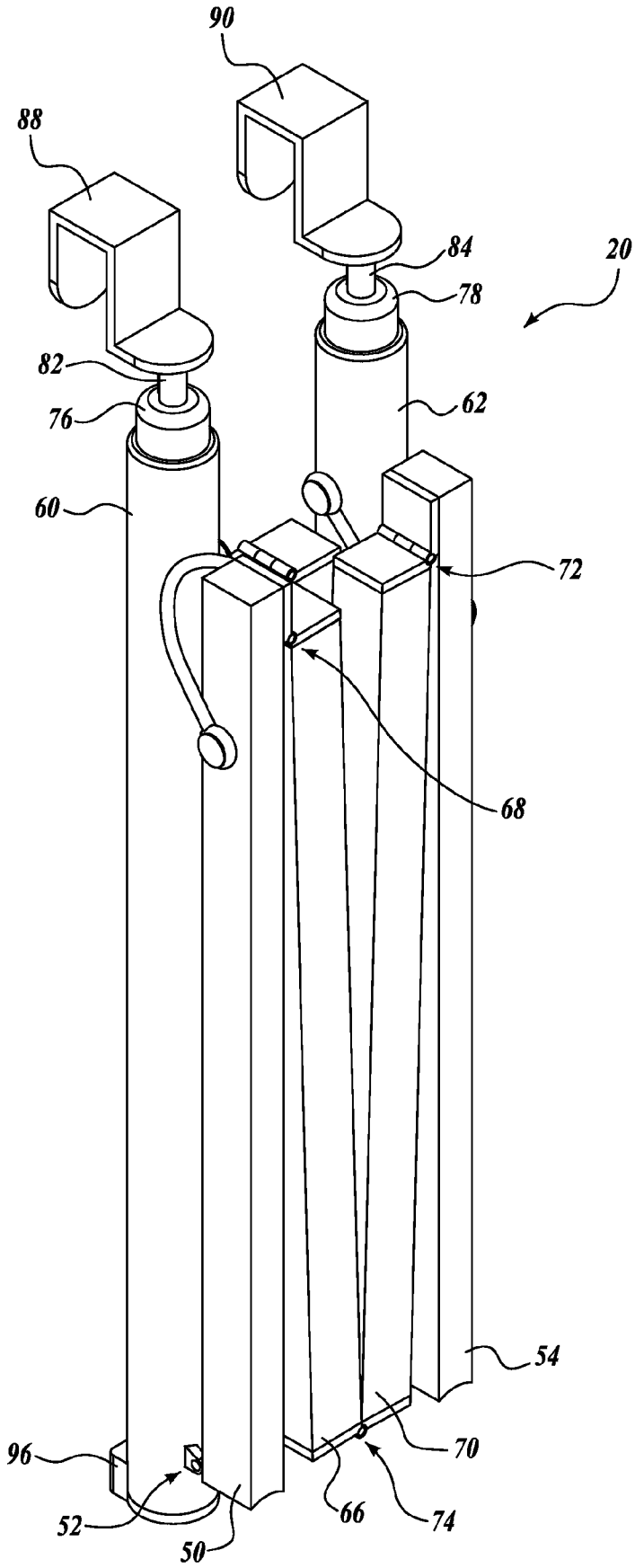
FIG. 2 is an isometric view of the portable changing table of FIG. 1 shown in a collapsed position, wherein a pad of the portable changing table has been removed.
Figure 3:
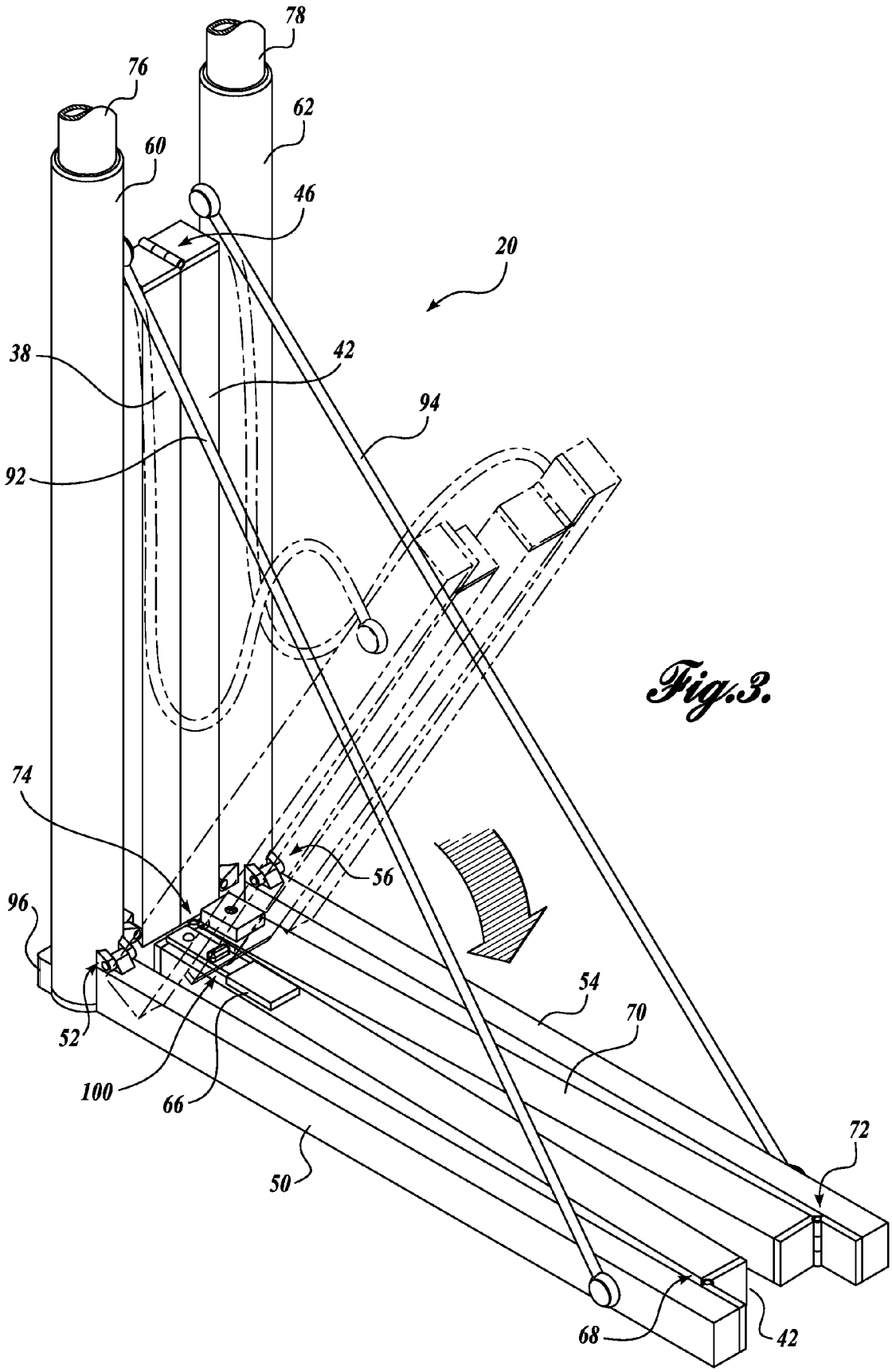
FIG. 3 is an isometric view of the portable changing table of FIG. 2 shown being moved into a deployed position.
Figure 4:
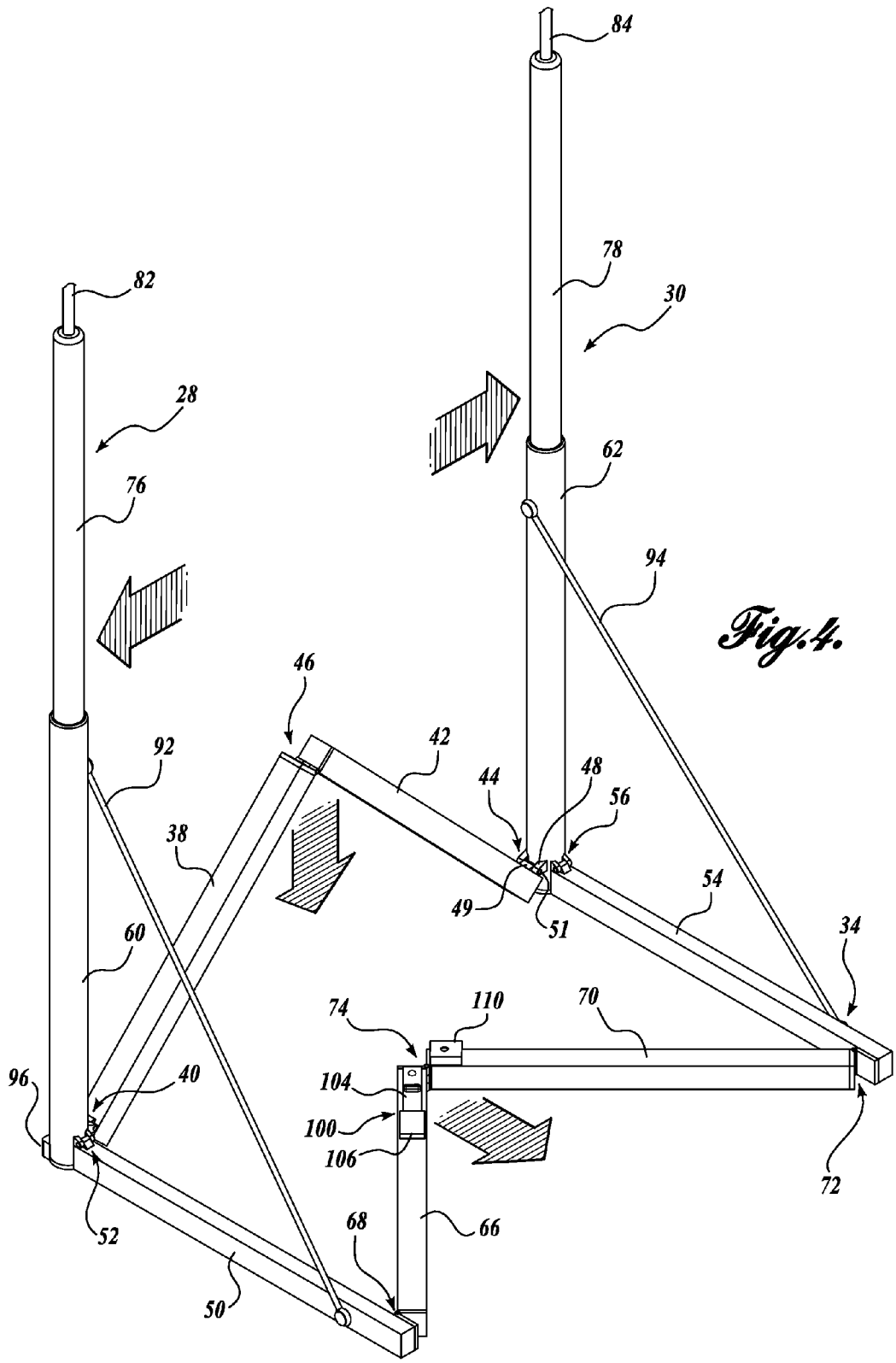
FIG. 4 is an isometric view of the portable changing table of FIG. 2 shown being moved into a further deployed position.

Referring to FIGS. 1-4, the collapsible base 24 of the portable changing table 20 will now be described in detail. Referring specifically to FIG. 4, the collapsible base 24 includes a frame 34 that is deployable into a substantially rectangular shape and a flexible support member, or diaper changing pad 36 secured to the frame 34. The frame 34 includes a first rear frame member 38 hingedly coupled to a portion of the first extendable arm assembly 28 at its first end and a second rear frame member 42 hingedly coupled to a portion of the second extendable arm assembly 30 at its first end. Although the first and second extendable arm assemblies 28 and 30 will be described in further detail below, the first and second extendable arm assemblies 28 and 30 include tubular bodies 60 and 62 at their lower ends. The first and second rear frame members 38 and 42 are hingedly coupled to the first and second tubular bodies 60 and 62 through first and second rear hinge assemblies 40 and 44.

The first and second rear hinge assemblies 40 and 44 may be any suitable hinge assemblies configured to allow the first and second rear frame members 38 and 42 to move between a collapsed position, wherein the first and second rear frame members 38 and 42 are positioned substantially parallel to one another between the first and second tubular bodies 60 and 62 (see FIGS. 2 and 3), and a deployed position, wherein the first and second rear frame members are in substantially axial alignment with one another and are substantially transverse to the longitudinal axes of the first and second tubular bodies 60 and 62 (see FIG. 1).

For instance, each hinge assembly 40 and 44 may include a well-known hinge yoke 48 secured to or otherwise formed on the tubular body of the extendable arm assembly, and a hinge pin collar 49 secured to or otherwise formed on the first end of the rear frame member that is received within the hinge yoke 48. A hinge pin 51 extends through the hinge yoke 48 and the hinge pin collar 49 to define a pivot axis and to hingedly couple the first end of the rear frame member to the corresponding tubular body. It should be appreciated that any other suitable hinge assembly may instead be used to hingedly couple the first and second rear frame members 38 and 42 to the first and second tubular bodies 60 and 62.

Moreover, in the embodiment depicted, the first and second rear frame members 38 and 42 have a substantially square or rectangular cross-section. In that regard, the first ends of the first and second rear frame members 38 and 42 may be contoured (see the contour of frame members 50 and 54 shown in FIG. 2) to engage and mate with the curved exterior of the first and second tubular bodies 60 and 62 when the frame 34 is in the deployed position to help stabilize the frame members in a substantially transverse position against the tubular bodies. However, it should be appreciated that the first and second rear frame members 38 and 42, as well as the other portions of the frame 34 may be any suitable cross-sectional shape, such as round, oval, etc. Moreover, as will be described below, the tubular bodies 60 and 62 may also be any suitable cross-sectional shape, such as square.

The first and second rear frame members 38 and 42 are hingedly coupled to one another at their second ends through a middle rear hinge assembly 46. The middle rear hinge assembly 46 may be any suitable hinge assembly configured to allow the first and second rear frame members 38 and 42 to move between a collapsed position, wherein the first and second rear frame members 38 and 42 are positioned substantially parallel to one another between the first and second tubular bodies 60 and 62 (see FIGS. 2 and 3), a deployed position, wherein the first and second rear frame members are in substantially axial alignment with one another and are substantially transverse to the longitudinal axes of the first and second tubular bodies 60 and 62 (see FIG. 1). In the embodiment depicted, the middle rear hinge assembly 46 is a continuous hinge, such as a piano hinge, that allows the second end surfaces of the first and second rear frame members 38 and 42 to substantially abut one another in the deployed position.

The frame 34 further includes first and second side frame members 50 and 54 extending from and hingedly coupled to the first and second tubular bodies 60 and 62 of the first and second extendable arm assemblies 28 and 30. The first and second side frame members 50 and 54 are hingedly coupled to the first and second tubular bodies 60 and 62 through suitable first and second side hinge assemblies 52 and 56. Although any suitable hinge assembly may be used, the first and second side hinge assemblies 52 and 56 are substantially similar to the hinge assemblies 40 and 44 described above.

The first and second side frame members 50 and 54 are hingedly coupled to the first and second tubular bodies 60 and 62 such that the first and second side frame members 50 and 54 may be moved between a collapsed position, wherein the first and second side frame members 50 and 54 are positioned substantially parallel to the first and second tubular members 60 and 62, and a deployed position, wherein the first and second side frame members 50 and 54 are substantially transverse to the first and second rear frame members 38 and 42 and the first and second tubular bodies 60 and 62. Although the first and second side frame members 50 and 54 may be any suitable shape and configuration, in the depicted embodiment, the first and second side frame members 50 and 54 have a substantially square or rectangular cross-sectional shape, similar to the first and second rear frame members 38 and 42 described above. In that regard, the first end of the first and second side frame members 50 and 54 that is hingedly coupled to the first and second tubular bodies 60 and 62 may be contoured (see FIG. 3) to engage and mate with the first and second tubular bodies 60 and 62 in the deployed position.

The frame 34 further includes first and second front frame members 66 and 70 that are hingedly coupled at their first ends to the first and second side frame members 50 and 54, respectively, through first and second front hinge assemblies 68 and 72. Although any suitable hinge assemblies may be used, the first and second front hinge assemblies 68 and 72 are shown as continuous hinges, similar to the middle rear hinge assembly 46 described above. In this manner, the first and second front frame members 66 and 70 may be moved into a deployed position with the first and second front frame members 66 and 70 being positioned substantially transversely to the first and second side frame members 50 and 54.

The first and second front frame members 66 and 70 are hingedly coupled together through a middle front hinge assembly 74 of any suitable design, such as a continuous hinge similar to hinge assemblies 68 and 72. As such, the first and second front frame members 66 and 70 may be moved between a collapsed position, wherein the first and second front frame members are substantially parallel to one another (see FIGS. 2 and 3), and a deployed position, wherein the first and second front frame members 66 and 70 are positioned in substantial axial alignment to one another and are substantially transverse to the first and second side frame members 50 and 54 (see FIG. 1).

As can be seen by referring to FIGS. 1-4, the frame 34 is moved between the collapsed and deployed positions by moving the frame members about the pivot axes defined by the hinge assemblies. In the deployed position, as shown in FIG. 1, the frame 34 is positioned substantially transversely to the tubular bodies 60 and 62. The diaper changing pad 36 extends across the frame 34 to receive a baby thereon. In the embodiment depicted, the diaper changing pad 36 is a piece of suitably durable fabric extending between the rear and front frame members 38 and 42 and 66 and 70, similar to a sling seat. As such, the diaper changing pad 36 may be collapsed within the frame members when the frame 34 is moved into the collapsed position. However, it should be appreciated that the diaper changing pad 36 may be any suitable material, such as foam or a layered foam and fabric construction. A safety strap (not shown) may also be provided to temporarily secure the baby on the pad 36.

The frame 34 is shown in the collapsed position in FIG. 2. To move the frame 34 into the collapsed position, the frame members are moved about the corresponding hinge assemblies to position each of the frame members in a substantially upright position, with each of the frame members being substantially parallel to and adjacent to one another and substantially parallel to the tubular bodies 60 and 62. It can be appreciated that in the collapsed position, the portable changing table 20 is suitable to be stowed and transported within, for instance, a diaper bag or purse.

Referring to FIG. 3, to move the frame 34 into the deployed position, the first and second side frame members 50 and 54 are moved about the pivot axes defined by side hinge assemblies 52 and 56 until the first and second side frame members 50 and 54 are positioned substantially transversely to the tubular bodies 60 and 62. As can be seen in FIG. 3, the ends of the first and second side frame members 50 and 54 engage the exterior of the first and second tubular bodies 60 and 62 to limit the travel of the first and second side frame members 50 and 54 and to position the first and second side frame members 50 and 54 substantially transversely to the first and second tubular bodies 60 and 62. However, it should be appreciated that the side hinge assemblies 52 and 56 may instead be configured to limit the movement of the first and second tubular bodies 60 and 62.

During or after the deployment of the first and second side frame members 50 and 54, the first and second rear frame members 38 and 42 and the first and second front frame members 66 and 70 may be deployed. Referring to FIG. 4, the first and second tubular bodies 60 and 62 are moved away from each other to move the first and second rear frame members 38 and 42 about the rear hinge assemblies 40, 44, and 46 and to move the first and second front frame members 66 and 70 about the middle front hinge assembly 74. The first and second tubular bodies 60 and 62 are moved away from each until the first and second rear frame members 38 and 42 are in substantial axial alignment the first and second front frame members 66 and 70 are in substantial axial alignment. In this manner, the rear, front, and side frame members of the frame 34 define a substantially rectangular, deployed base 24.

It can be appreciated that when the extendable arm assemblies 28 and 30 are secured to a support structure (as will be described below), the rear frame members 38 and 42 and the side frame members 50 and 54 remain in a deployed, substantially transverse position relative to the tubular bodies 60 and 64 due to gravitational effects. However, the front frame members 66 and 70 could move about the middle front hinge assembly 74 when in use. In that regard, a locking or latch mechanism 100 may be secured to a portion of the first and second front frame members 66 and 70 together to temporarily lock the front frame members 66 and 70 in the deployed position.

Figure 5A:
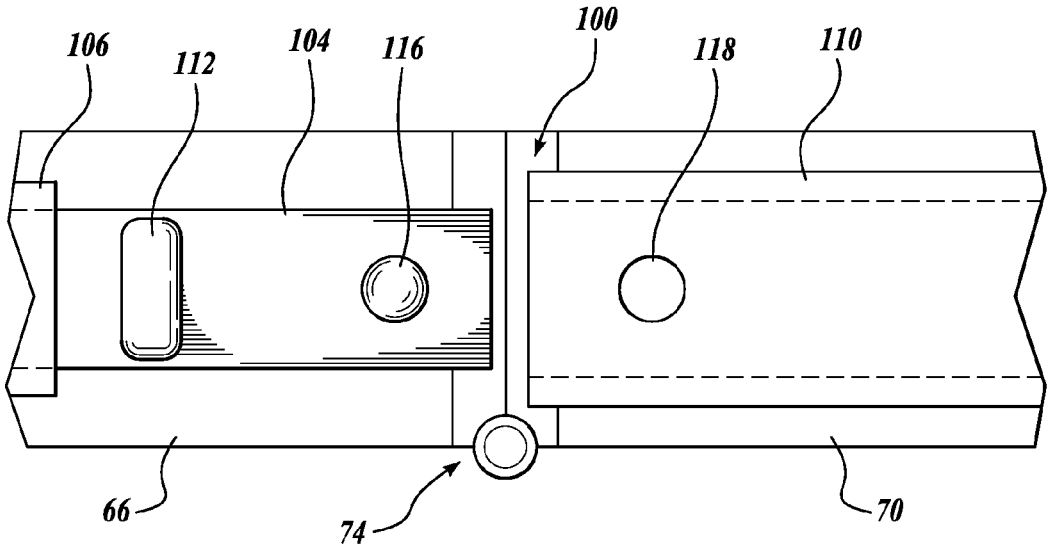
FIG. 5A is a latch mechanism for use with the portable changing table of FIG. 1, wherein the latch mechanism is shown in an unlocked position.
Figure 5B:
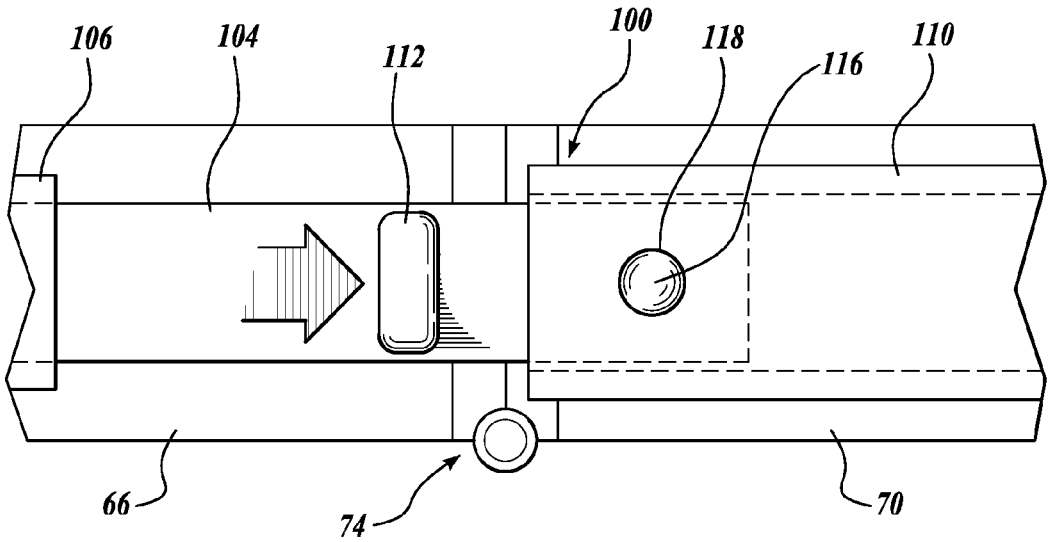
FIG. 5B is a latch mechanism for use with the portable changing table of FIG. 1, wherein the latch mechanism is shown in a locked position.

Referring to FIGS. 5A and 5B, the latch mechanism 100 may be any suitable design configured to temporarily lock or secure the front frame members 66 and 70 in the deployed position. In the depicted embodiment, the latch mechanism 100 includes a locking member 104 slidably received within a first locking member sleeve or receptacle 106 secured to or otherwise formed on an exterior surface of the first front frame member 66 near the middle front hinge assembly 74. The locking member 104 is slidably receivable within a second locking member sleeve or receptacle 110 secured to or otherwise formed on an exterior surface of the second front frame member 70 near the middle front hinge assembly 74. A knob or handle 112 may be provided on the locking member 104 to help move the locking member 104 into and out of engagement with the second locking member receptacle 110.

With the locking member 104 extending across the joint defined between the first and second front frame members 66 and 70, the first and second front frame members 66 and 70 cannot move about the pivot axis defined by the middle front hinge assembly 74. As such, the first and second front frame members 66 and 70 are temporarily locked in the deployed position.

To secure the locking member 104 in this locked position, the latch mechanism 100 may include a lock detent mechanism having a lock detent, such as a spring-loaded ball or clip, receivable within a corresponding hole 118 formed in the outer surface of the second locking member receptacle 110. The lock detent 116 may be depressed when sliding the locking member 104 within the second locking member receptacle 110 until the lock detent 116 is received within the hole 108. If the lock detent 116 is a spring-loaded ball, the lock detent 116 will be urged upwardly within the hole 108 as it reaches the hole 108, thereby providing a tactile sensation to the user that the latch mechanism 100 is locked.

To unlock the latch mechanism 100, the lock detent 116 is depressed until the locking member 104 can be slid outwardly from within the second locking member receptacle 110. It should be appreciated that any other suitable lock detent mechanism or locking device may instead be used. Moreover, it should be appreciated that the latch mechanism 100 may instead be any other suitable design, such as a thumb turn latch, a lock barrel latch, etc. Accordingly, the foregoing description and illustrations herein should not be seen as limiting the scope of the claimed subject matter.

Referring back to FIGS. 1-4, the frame 34 is hingedly coupled to the first and second tubular bodies 60 and 62 of the first and second extendable arm assemblies 28 and 30, as generally described above. The first and second extendable arm assemblies 28 and 30 extend substantially transversely upwardly from the frame 34 when the frame 34 is in the deployed position.

The first and second extendable arm assemblies 28 and 30 are of a suitable design such that the assemblies may be moved between a collapsed, stowed position and an extended, changing table position. Although any suitable design may be used, the depicted first and second extendable arm assemblies 28 and 30 have telescoping features to allow the first and second extendable arm assemblies 28 and 30 to move between the collapsed and extended positions.

In general, each of the first and second extendable arm assemblies 28 and 30 include first and second extension tubes 76 and 78 slidably received within an upper open end of the first and second tubular bodies 60 and 62. Moreover, first and second mounting rods 82 and 84 are slidably received within an upper open end of the first and second extension tubes 76 and 78. The extendable arm assemblies 28 are configured. It should be appreciated that the first and second extendable arm assemblies 28 and 30 may include fewer or more telescoping features to shorten or lengthen the overall length of the extendable arm assemblies 28 and 30.

First and second hooks 88 and 90 are secured to the upper ends of the first and second mounting rods 82 and 84. The first and second hooks 88 and 90 are configured to suitably mount the first and second extendable arm assemblies 28 and 30 to a support structure, such as the upper edge of a bathroom stall S. In that regard, any other suitable mounting structure (such as a loop securable on a hook or a peg, a latch mechanism, etc.) may be used to secure the portable changing table 20 to a similar or a different support structure. The hooks 88 and 90 may be coated or covered with a suitable non-slip surface or material, such as rubber, to help stabilize and securely position the hooks 88 and 90 on the support structure.

Furthermore, one or more bumpers 96 or non-slip pads (made from rubber or another suitable material) may be secured to a bottom portion of the extendable arm assemblies 28, 30 or any other portion of the portable changing table 20 that engages the support structure S to further stabilize the portable changing table 20 against the support structure S. For instance, a bumper 96 may be secured at the lower end of each tubular body 60 and 62.

Referring to FIGS. 6-9, an exemplary telescoping design suitable for allowing the extendable arm assembly 28, 30 to move between a collapsed, portable position, and an extended, changing table position will be hereinafter described in detail. It should be appreciated that the first and second extendable arm assemblies 28 and 30 are substantially identical in design; and therefore, only the first extendable arm assembly 28 will be hereinafter described in further detail.

Figure 6:
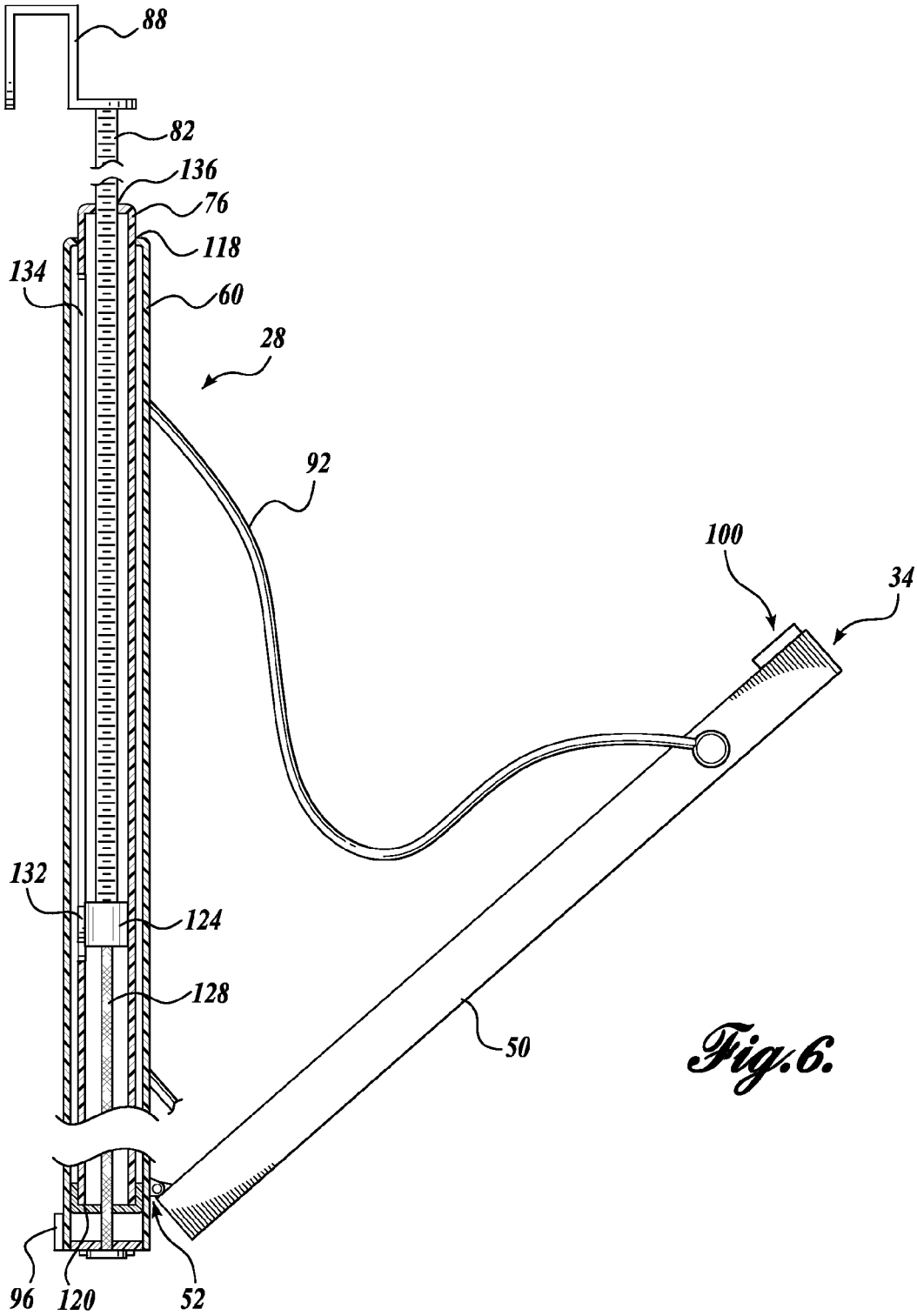
FIG. 6 is a partial cross-sectional side view of the portable changing table of FIG. 1 shown in a partially deployed position.
Figure 7:
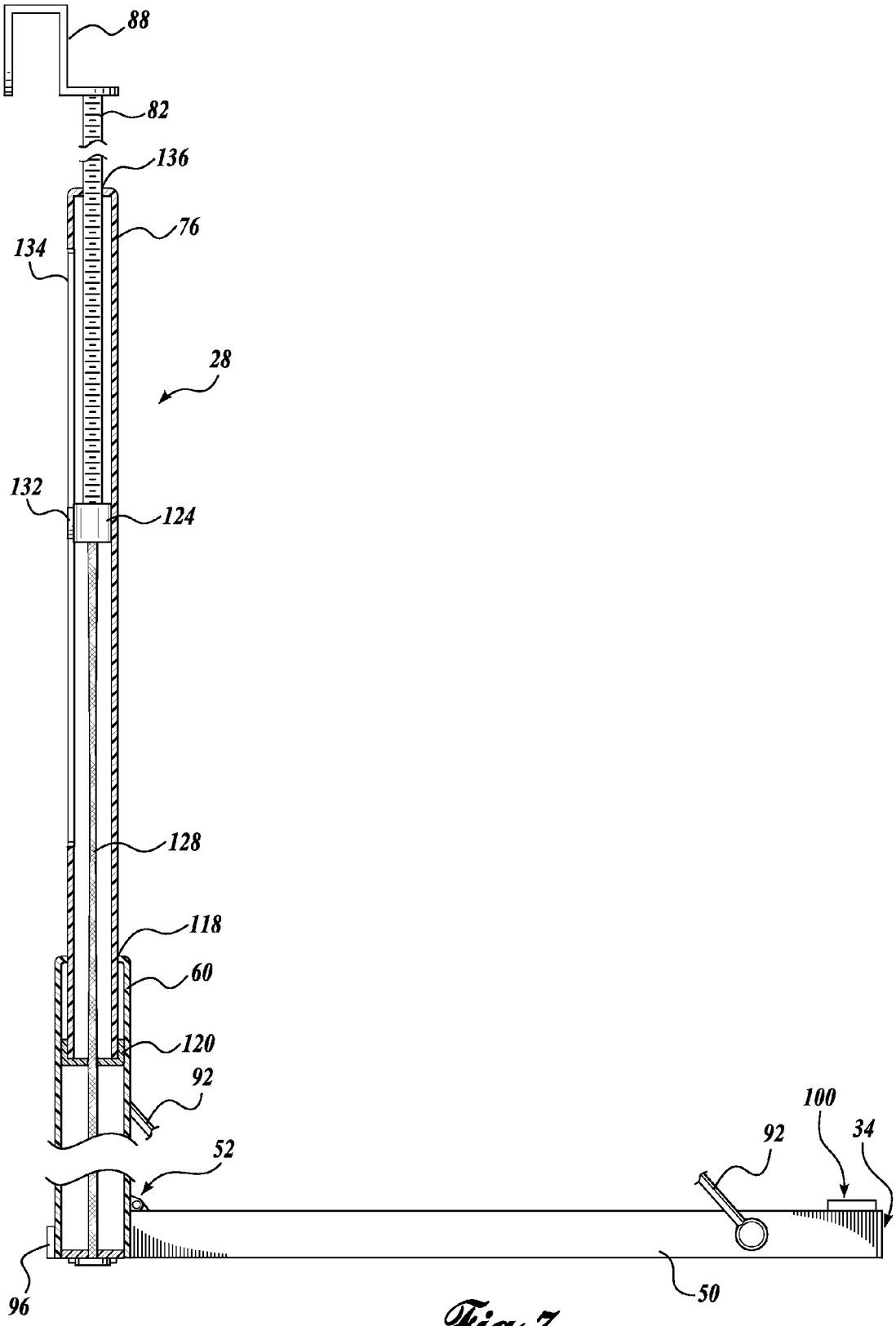
FIG. 7 is a partial cross-sectional side view of the portable changing table of FIG. 1 shown in a deployed position.

Referring specifically to FIGS. 6 and 7, the first extendable arm assembly 28 includes a first extension tube 76 slidably received within an upper open end of the first tubular body 60. The first extension tube 76 and first tubular body 60 are substantially cylindrical in shape (and circular in cross-section) such that the first extension tube 76 may slide linearly within the first tubular body 60. However, it should be appreciated that the first extension tube 76 and first tubular body 60 may instead be any suitable cross-sectional shape, such as square, rectangular, or another polygonal shape. For instance, if the first extension tube 76 was the same polygonal cross-sectional shape as the first tubular body 60 (such as square), the first extension tube 76 would not rotate within the first tubular body 60 during linear translation.

The first extension tube 76 includes an end stop 120 secured to its lower end. In the depicted embodiment, the end stop 120 is configured as a cap received on the lower end of the first extension tube 76. The end stop 120 is greater in width than the first extension tube 76 such that the end stop 120 is engageable with the upper interior surface of the first tubular body 60 when the first extension tube 76 is fully extended. As such, the end stop 120 limits the linear movement of the first extension tube 76 and retains the first extension tube 76 within the first tubular body 60. The end stop 120 may also be made from a suitable low-friction material to act as a linear bushing for the first extension tube 76 when moving within the first tubular body 60. It should be appreciated that other mechanisms for guiding and restraining the movement of the first extension tube 76 within the first tubular body 60 may also be used.

The first extension tube 76 slidably receives the first mounting rod 82 therein. The first mounting rod 82 is adjustably secured within a bushing 124 at its lower end, wherein the bushing 124 is sized and configured to help guide the linear movement of the first mounting rod 82 within the first extension tube 76. The bushing 124 may abut the interior upper surface of the first extension tube 76 to limit the linear travel of the first mounting rod 82 and to retain the first mounting rod 82 within the first extension tube 76.

The bushing 124 may include a bushing key 132 protruding from its exterior surface that is receivable within a slot 134 extending longitudinally along at least a portion of the length of the first extension tube 76. The interaction of the bushing key 132 and the slot 134 substantially prevents the bushing 124, and therefore the first mounting rod 82, from rotating within the first extension tube 76. The slot 134 may also be of a predetermined length to limit the linear travel of the first mounting rod 82 within the first extension tube 76.

The first mounting rod 82 is also secured at its lower end to a biasing member 128 through any suitable means (not shown). In the depicted embodiment, the biasing member 128 is an elastic cord that extends between the lower end of the first mounting rod 82 and the lower end of the first tubular body 60 to bias the first mounting rod 82 into a retracted position within the first extension tube 76. The biasing member 128 extends through an opening (not labeled) in the end stop 120 of the first extension tube 76 and is secured to the lower end of the first tubular body 60 with any suitable means, such as with a knot or fastener. The biasing member 128 helps move the extendable arm assembly 28 into the collapsed position after use. It should be appreciated that any suitable biasing member may instead be used, such as an extension spring, a gas strut, etc.

Figure 8:
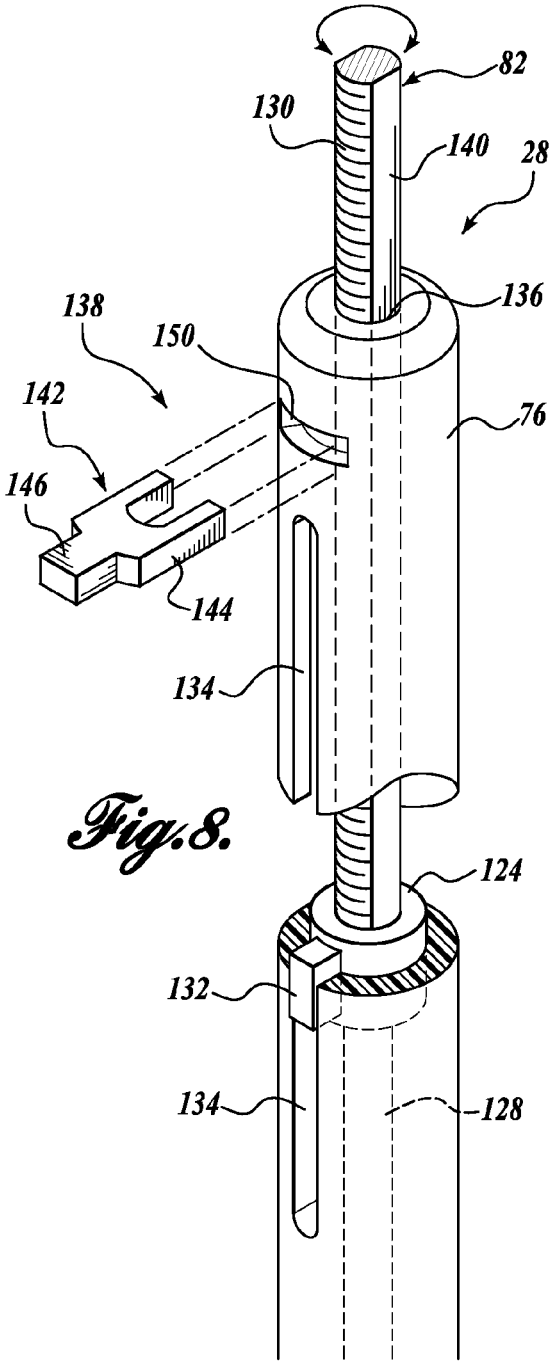
FIG. 8 is an isometric view of a portion of an arm assembly of the portable changing table of FIG. 1, wherein the arm assembly is shown in a first position.
Figure 9:
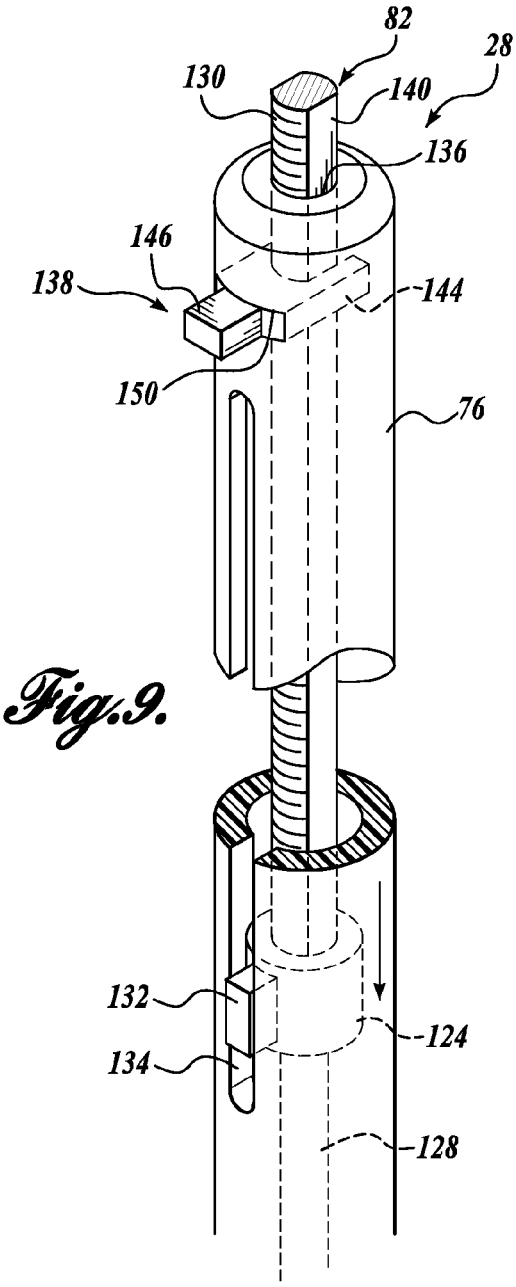
FIG. 9 is an isometric view of a portion of an arm assembly of the portable changing table of FIG. 1, wherein the arm assembly is shown in a second position.

Referring to FIGS. 8 and 9, an exemplary configuration of an adjustment assembly for adjustably mounting the first mounting rod 82 within the bushing 124 will now be described in detail. In the illustrated embodiment, the first mounting rod 82 has longitudinal opposing threaded exterior surfaces 130 (only one shown) interspaced by longitudinal opposing chamfered exterior surfaces 140 (only one shown). The first mounting rod 82 is rotatable within a rod opening 136 in the upper end of the first extension tube 76 such that the bottom end of the first mounting rod 82 may be threaded within a threaded opening (not shown) in the bushing 124. With the bushing key 132 received within the slot 134, the bushing 124 is prevented from rotating, thereby allowing the first mounting rod 82 to be threaded within the bushing 124.

The first mounting rod 82 is threaded within the bushing 124 until a desired length of the first mounting rod 82 extends upwardly from the bushing 124. As noted above, the bushing 124 limits the linear travel of the first mounting rod 82 within the first extension tube 76. Therefore, the bushing 124 limits the length of the first mounting rod 82 protruding from the first extension tube 76 when the first extendable arm assembly 28 is in the deployed, extended position. Thus, to shorten or lengthen the protruding first mounting rod 82, the first mounting rod 82 can be threaded further into or out of the bushing 124. This may be desired to accommodate different support structures or users of different heights.

After adjusting the first mounting rod 82 to the desired length, a rod locking mechanism 138 may be used to prevent rotation of the first mounting rod 82 within the first extension tube 76. Although any suitable mechanism may be used to prevent rotation of the first mounting rod 82 within the first extension tube 76, the depicted rod locking mechanism 138 includes a rod locking key 142 that is engageable with the first mounting rod 82.

The rod locking key 142 includes a substantially U-shaped portion 144 that is sized and shaped to surround a portion of the first mounting rod 82 and engage the opposing chamfered surfaces 140 of the first mounting rod 82. The U-shaped portion 144 is receivable within a transverse slot 150 formed within the first extension tube 76 such that the rod locking key 142 is substantially fixed in its position when received within the slot 150. A spring clip, snap-locking feature, etc. (not shown), may be provided on the first extension tube 76 to releasably retain the locking key 142 within the slot 150. The U-shaped portion 144 extends into the slot 150 and engages the chamfered surfaces 140 to prevent rotation of the first mounting rod 82 with respect to the first extension tube 76.

The rod locking key 142 includes a tab portion 146 extending from the U-shaped portion 144 that is positioned exterior of the first extension tube 76 when the U-shaped portion 144 is received therein. The tab portion 146 can be used to move the U-shaped portion 144 into and out of the slot 150.

It should be appreciated that any other suitable rod locking mechanism may instead be used to prevent rotation of the first mounting rod 82 within the first extension tube 76, such as a ball detent mechanism, a collar assembly, etc. Thus, the foregoing description should not be seen as limiting the scope of the present disclosure.

Figure 10:
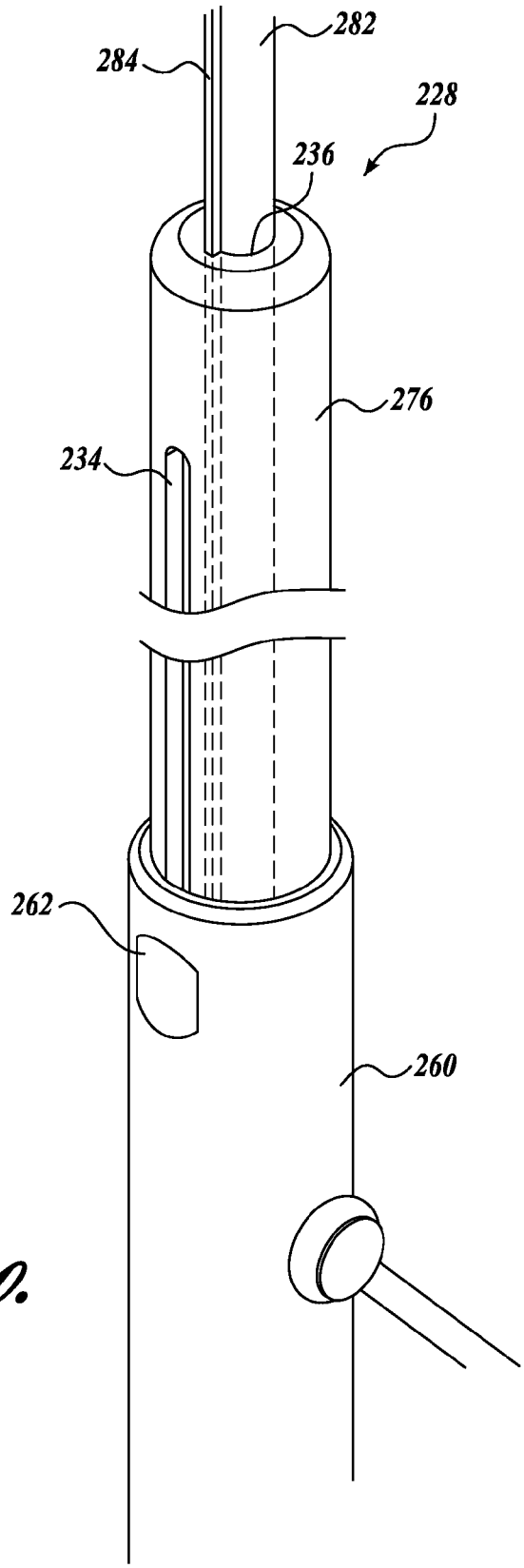
FIG. 10 is an isometric view of a portion of an alternate embodiment of an arm assembly of the portable changing table of FIG. 1.

Referring to FIG. 10, an alternate embodiment of an extendable arm assembly 228 is depicted. The extendable arm assembly 228 is substantially similar to the first extendable arm assembly 28 described above except for the differences hereinafter described. The extendable arm assembly 228 includes a mounting rod 182 slidably received within an extension tube 276, wherein the extension tube 276 is slidably received within a tubular body 260. The tubular body 260 includes an extension tube key 262 (shown partially in FIG. 10) that extends inwardly into a longitudinal slot 234 formed along the length of the extension tube 276. The key 262 prevents rotation of the extension tube 276 within the tubular body 260.

The mounting rod 182 of the extendable arm assembly 228 is non-threaded and is substantially circular in cross-section. As such, the mounting rod 182 is fixedly secured within a bushing (not shown) slidably received within the extension tube 276. This configuration may be desired where adjustment of the mounting rod 182 length is not needed. The mounting rod 182 further includes a longitudinal key 284 extending along the length of the exterior surface of the mounting rod 182. The opening 236 in the upper end of the extension tube 276 substantially corresponds to the combined cross-sectional shape of the mounting rod 182 and key 284. In this manner, the mounting rod 182 is not rotatable within the extension tube 276. Rather, the mounting rod 182 can only move linearly within the extension tube 276 between the collapsed, or retracted positions and the deployed, or extended positions.

It can be appreciated from the foregoing that the portable changing table 20 provides a safe, convenient, clean place to perform a diaper change away from home. Furthermore, the portable changing table 20 is suitably compact and portable such that it may be easily transported and used in a variety of situations and places.

Figure 11:
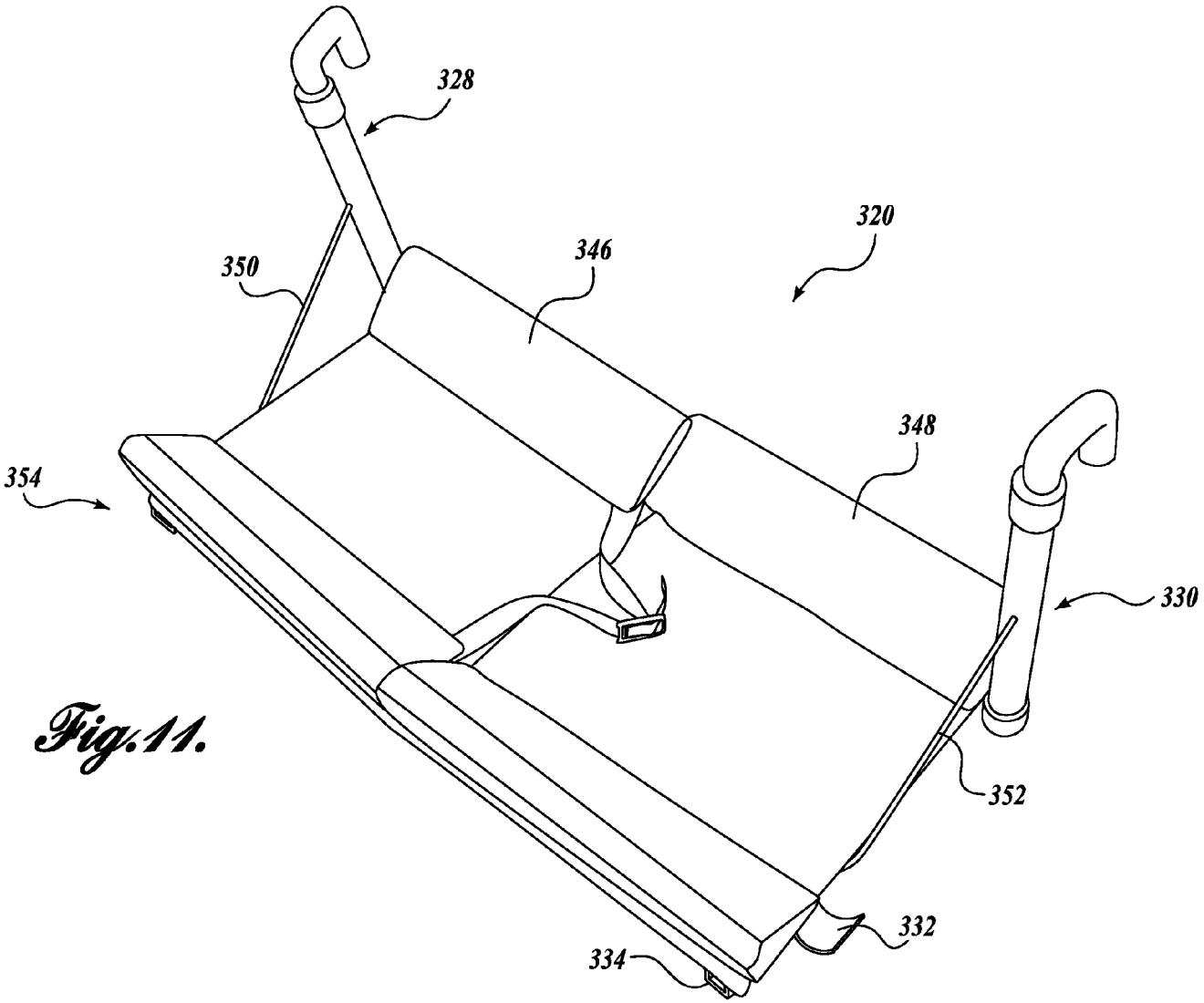
FIG. 11 is an isometric front view of a first alternate embodiment of a portable changing table formed in accordance with the present disclosure.
Figure 12:
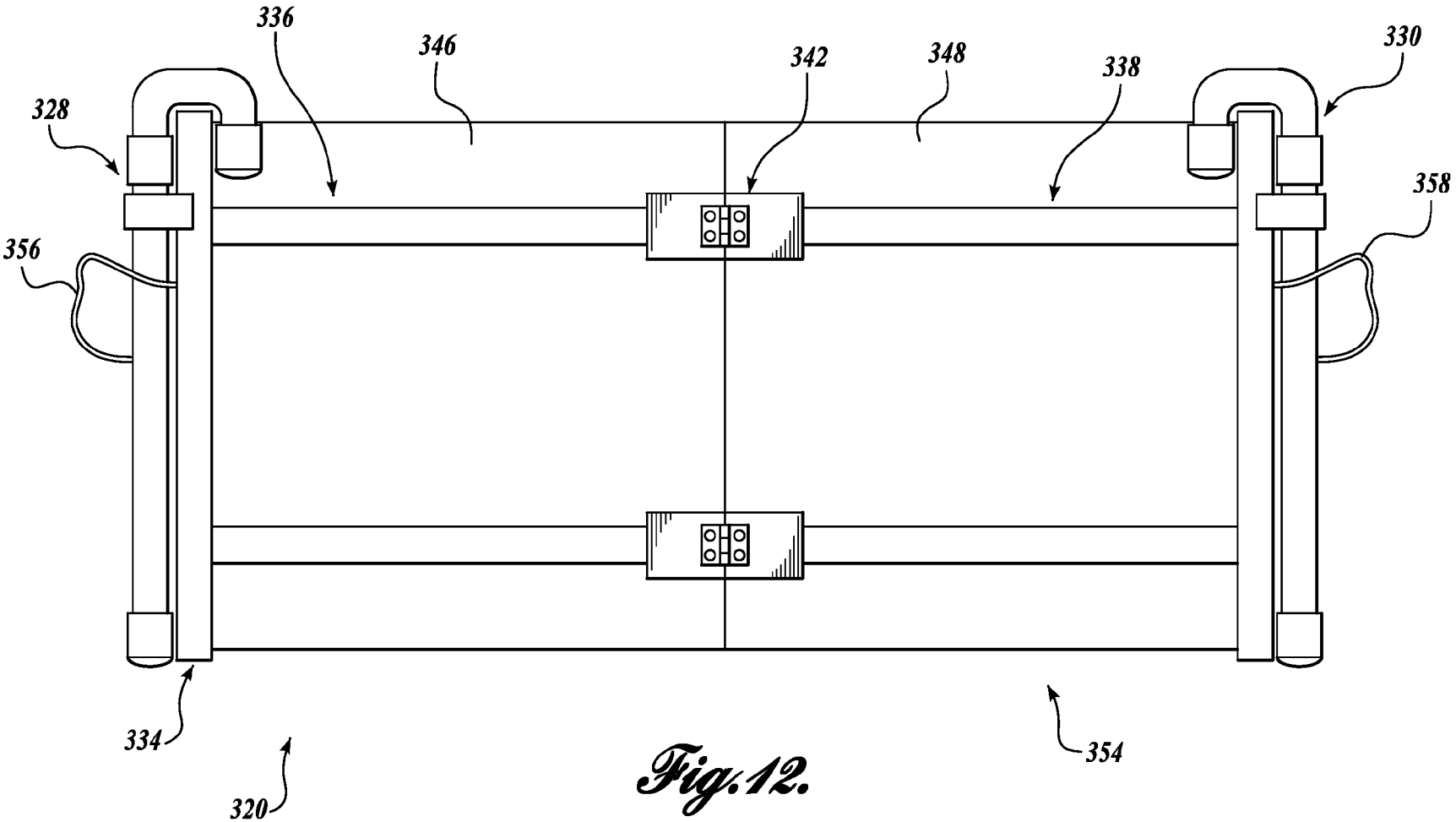
FIG. 12 is a rear planar view of the portable changing table of FIG. 11.

Referring to FIGS. 11 and 12, a first alternate embodiment of a portable changing table 320 is depicted. The portable changing table 320 includes a base 354 hingedly coupled to first and second extendable arm assemblies 328 and 330. The base 354 is defined by a frame 334 having first and second frame portions 336 and 338 that support first and second pads 346 and 348, respectively. The first and second frame portions 336 and 338 are hingedly coupled to one another by one or more hinge assemblies 342 that define a hinge pivot axis. The hinge assemblies 342 allow the first and second frame portions 336 and 338, and therefore the first and second pads 346 and 348, to fold about the hinge pivot axis into a collapsed position.

The first and second extendable arm assemblies 328 and 330 are substantially similar to the first and second extendable arm assemblies 28 and 30 described above. The first and second extendable arm assemblies 328 and 330 are hingedly coupled to a portion of the frame 334 with any suitable hinge assembly (not shown) that allows the first and second extendable arm assemblies 328 and 330 to moved between a deployed and collapsed position. In the deployed position, as shown in FIG. 11, the first and second extendable arm assemblies 328 and 330 are positioned substantially transversely to the plane of the frame 334. First and second support straps 350 and 352 may extend between the first and second extendable arm assemblies 328 and 330 and the frame 334 to position and support the frame 334 (and therefore the pads 346 and 348) in a substantially transverse position relative to the extendable arm assemblies 328 and 330.

In the collapsed position, the first and second extendable arm assemblies 328 and 330 are positioned alongside an edge of the frame 334. A clip 332 may extend from each edge of the frame 334 to receive and stow the respective extendable arm assembly in the collapsed position.

With the extendable arm assemblies 328 and 330 in the collapsed, stowed position, the frame 334 may be folded along the hinge pivot axis defined by the hinge assemblies 342. First and second handles 356 and 358 may extend from each edge of the frame 334 for carrying the portable changing table 320 in the folded configuration. The portable changing table 320 may include one or more pouches secured to the underside of the frame for storing or transporting accessories, such as diapers, wipes, etc.

Figure 13:
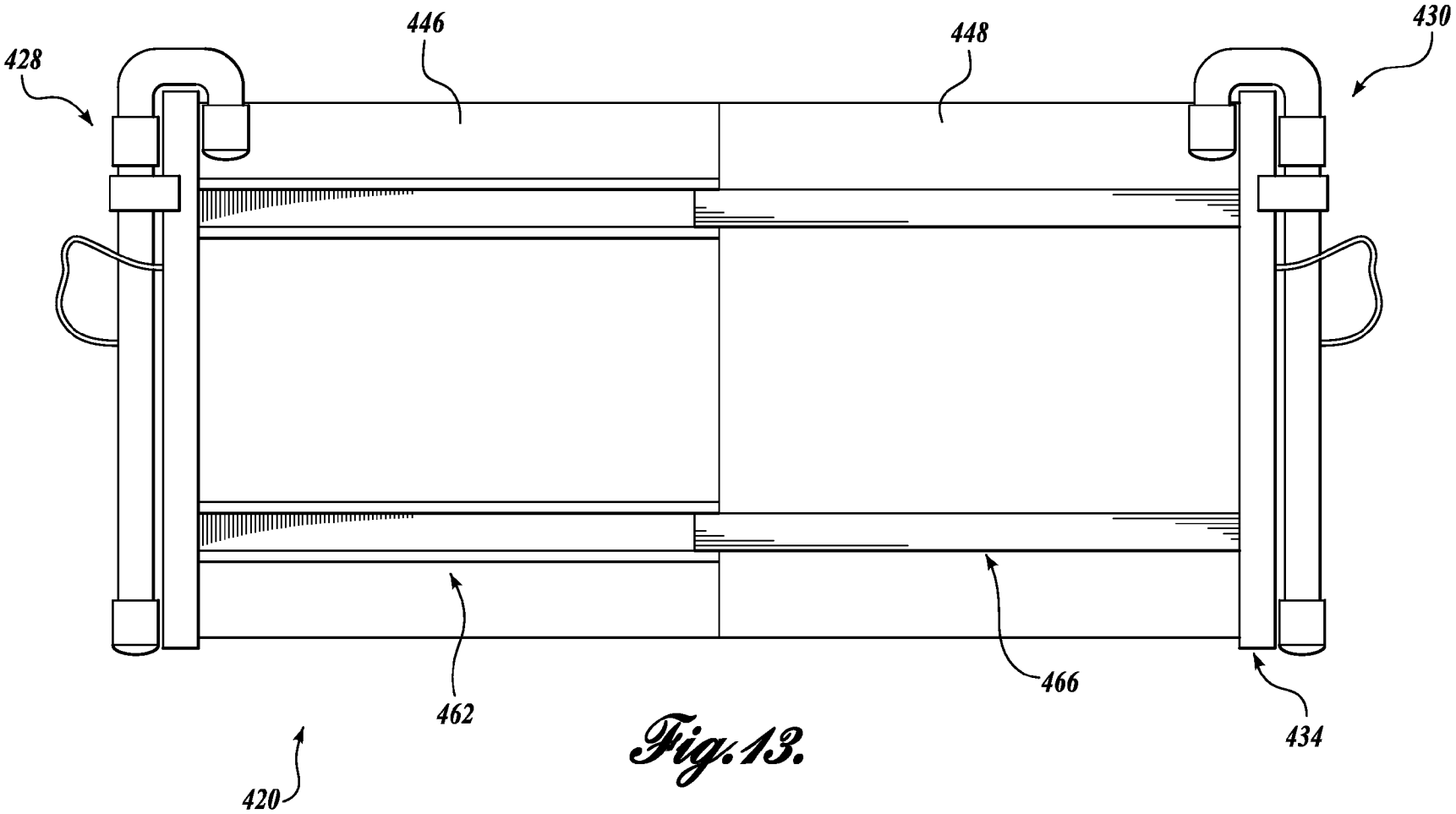
FIG. 13 is a rear planar view of a second alternate embodiment of a portable changing table formed in accordance with the present disclosure.

Referring to FIG. 13, a second alternate embodiment of a portable changing table 420 is depicted. The portable changing table 420 is substantially identical to the portable changing table 320 described above except the frame 434 is not moveable about a hinge pivot axis to collapse the table into a folded configuration. In the alternative, the frame 434 includes first and second portions that support first and second pads 446 and 448, wherein the first frame portion is defined in part by one or more slide rail tracks 462 and the second frame portion is defined in part by one or more slide rails 466. The slide rails 466 are slidably received within the slide rail tracks 462 to collapse the portable changing table 420 for transport or storage.

While illustrative embodiments have been illustrated and described, it will be appreciated that various changes can be made therein without departing from the spirit and scope of the present disclosure.

The invention claimed is:

1. A portable changing table, comprising:

(a) at least one extendable arm assembly moveable between a retracted position and an extended position, the at least one extendable arm assembly removably securable to a support structure, wherein the at least one extendable arm assembly includes a biasing member for urging the at least one extendable arm assembly into the retracted position;

(b) a collapsible frame hingedly secured to the at least one extendable arm assembly, the collapsible frame moveable between a stowed position and a deployed position; and (c) a flexible support member secured to a portion of the collapsible frame, the flexible support member extending across a portion of the collapsible frame in the deployed position.

2. The portable changing table of claim 1, further comprising a locking mechanism secured on the collapsible frame that is configured to selectively lock the collapsible frame in the deployed position.

3. The portable changing table of claim 1, wherein the at least one extendable arm assembly includes a mounting rod having a first end slidably received within an extension tube and a second end protruding from a first end of the extension tube.

4. The portable changing table of claim 3, wherein the first end of the mounting rod is adjustably secured within a bushing slidably received within the extension tube.

5. The portable changing table of claim 4, wherein the first end of the mounting rod is threadably received within the bushing.

6. The portable changing table of claim 4, wherein the interface of the bushing and the extension tube substantially prevents rotation of the bushing relative to the extension tube.

7. The portable changing table of claim 4, wherein the biasing member extends between the first end of the mounting rod and a second end of the extension tube.

8. The portable changing table of claim 4, further comprising a rod locking mechanism configured to substantially prevent rotation of the mounting rod relative to the extension tube.

9. The portable changing table of claim 1, wherein the collapsible frame is foldably about a hinge assembly.

10. The portable changing table of claim 1, wherein the collapsible frame includes a first frame portion having a slide rail track and second portion having a slide rail slidably receivable within the slide rail track.

11. The portable changing table of claim 1, further comprising first and second extendable arm assemblies moveable between retracted and extended positions.

12. The portable changing table of claim 11, wherein the collapsible frame comprises:

(a) a first rear frame member hingedly secured to the first extendable arm assembly at a first end and a second rear frame member hingedly secured to the second extendable arm assembly at a first end, the first and second rear frame members hingedly coupled together at their second ends;

(b) a first side frame member hingedly secured to the first extendable arm assembly at a first end and a second side frame member hingedly secured to the second extendable arm assembly at a first end; and (c) a first front frame member hingedly secured to the first side frame member at a first end and a second front frame member hingedly secured to the second side frame member at a first end, the first and second front frame members hingedly coupled together at their second ends.

13. The portable changing table of claim 12, wherein the rear, side, and front frame members are moveably about hinge assemblies between a collapsed and deployed position.

14. The portable changing table of claim 12, further comprising a locking mechanism secured on the collapsible frame that is configured to selectively lock the first and second front frame members in the deployed position.

15. The portable changing table of claim 1, further comprising an adjustment assembly for selectively adjusting the height of the at least one extendable arm assembly in the extended position.

16. A portable changing table, comprising:

(a) first and second extendable arm assemblies removably securable to a support structure, each extendable arm assembly moveable between a retracted position and an extended position;

(b) a biasing device configured to urge the first and second extendable arm assemblies into the retracted position;

(c) an adjustment assembly for selectively adjusting the height of the first and second extendable arm assemblies in the extended position;

(d) a collapsible frame hingedly secured to the first and second extendable arm assemblies, the collapsible frame moveable between a stowed position and a deployed position; and (e) a flexible support member secured to a portion of the collapsible frame, the flexible support member extending across a portion of the collapsible frame in the deployed position.

17. The portable changing table of claim 16, further comprising a locking mechanism secured on the collapsible frame that is configured to selectively lock the collapsible frame in the deployed position.

18. The portable changing table of claim 16, wherein the collapsible frame comprises:

(a) a first rear frame member hingedly secured to the first extendable arm assembly at a first end and a second rear frame member hingedly secured to the second extendable arm assembly at a first end, the first and second rear frame members hingedly coupled together at their second ends;

(b) a first side frame member hingedly secured to the first extendable arm assembly at a first end and a second side frame member hingedly secured to the second extendable arm assembly at a first end; and (c) a first front frame member hingedly secured to the first side frame member at a first end and a second front frame member hingedly secured to the second side frame member at a first end, the first and second front frame members hingedly coupled together at their second ends.

* * * * *